US007015431B2

(12) United States Patent
Yoshimura

(10) Patent No.: US 7,015,431 B2
(45) Date of Patent: Mar. 21, 2006

(54) IMAGE FORMING APPARATUS WITH AT LEAST TWO ALTERNATELY-CONTROLLED ELECTRIC HEATING ELEMENTS

(75) Inventor: Shotaro Yoshimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/457,359

(22) Filed: Jun. 10, 2003

(65) Prior Publication Data

US 2003/0230564 A1 Dec. 18, 2003

(30) Foreign Application Priority Data

Jun. 13, 2002 (JP) ..... 2002-172535

(51) Int. Cl.
*H05B 1/02* (2006.01)

(52) U.S. Cl. ..... 219/486; 219/216; 399/330

(58) Field of Classification Search ..... 219/216, 219/486, 487, 497, 388, 483; 355/285, 289, 355/290; 399/330, 69

See application file for complete search history.

(56) References Cited

U.S. PATENT DOCUMENTS

| | | | | |
|---|---|---|---|---|
| 3,998,539 A | * | 12/1976 | Kidd | 399/178 |
| 5,148,226 A | | 9/1992 | Setoriyama et al. | 355/290 |
| 5,210,579 A | | 5/1993 | Setoriyama et al. | 355/285 |
| 5,512,993 A | * | 4/1996 | Endo et al. | 399/335 |
| 5,525,775 A | | 6/1996 | Setoriyama et al. | 219/216 |
| 5,994,671 A | * | 11/1999 | Suzuki et al. | 219/216 |
| 6,301,454 B1 | * | 10/2001 | Nishida et al. | 399/69 |

FOREIGN PATENT DOCUMENTS

| | | | |
|---|---|---|---|
| JP | 58-134655 | * | 8/1983 |
| JP | 63-184776 | * | 7/1988 |
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 7-271238 | * | 10/1995 |
| JP | 9-258599 | * | 10/1997 |
| JP | 10-10917 | * | 1/1998 |
| JP | 10-91017 | | 4/1998 |
| JP | 11-339930 | * | 12/1999 |

* cited by examiner

*Primary Examiner*—John A. Jeffery
(74) *Attorney, Agent, or Firm*—Fitzpatrick, Cella, Harper & Scinto

(57) ABSTRACT

In a heating apparatus in which a plurality of heating bodies are provided and a ratio of an electrical amounts supplied to the respective heating bodies can be changed, two or more phase electrical power supplying devices for supplying electrical power to the heating bodies in accordance with a phase of AC voltage are provided, and a heating ratio of the heating body is changed by thinning, at a predetermined rate, phase wave forms for supplying an electrical power to one of the heating bodies among combinations of the heating body and the phase electrical power supplying devices, thereby preventing increase in terminal noise voltage.

10 Claims, 5 Drawing Sheets

IMAGE FORMING APPARATUS WITH AT LEAST TWO ALTERNATELY-CONTROLLED ELECTRIC HEATING ELEMENTS

BACKGROUND OF THE INVENTION

1. Field of the Invention

The present invention relates to a heating apparatus having at least two heating bodies and an image forming apparatus using such a heating apparatus as a thermal fixing apparatus for fixing an image.

2. Related Background Art

A conventional image forming apparatus using an electro-photographic process will now be explained.

A thermal fixing apparatus in the image forming apparatus serves to fix an unfixed image (toner image), which was formed on a recording paper by image forming means such as an electro-photographic process, on the recording paper, and a thermal fixing apparatus of heat roller type utilizing a halogen heater as a heat source and a thermal fixing apparatus of film heating type utilizing a heater in which a ceramic surface thereof generates heat (referred to as "heater" hereinafter) as a heat source are known.

FIG. 7A is a schematic sectional view showing a fixing nip portion of an example of a fixing apparatus of film heating type utilizing a heating member having two heating bodies as a heat source. FIG. 7B is a partially fragmental schematic plan view showing a front side of the heating member and FIG. 7C is a schematic plan view showing a back side of the heating member.

In FIG. 7A, a heating member as a heater 1 includes two heating bodies in this example. The heater 1 is held and fixed by a heat-resistive rigid support 2. A heat-resistive film (referred to as "fixing film" hereinafter) 3 as a shifting member is closely contacted with the heater 1 by a pressurizing roller 4 as a pressurizing member and is slidingly shifted so that a recording material S as a heated material onto which an image is to be fixed is introduced between the fixing film 3 and the pressurizing roller 4 of an abutment nip portion (referred to as "fixing nip portion" hereinafter) N defined between the heater 1 and the pressurizing roller 4 with the interposition of the fixing film 3, with the result that, by conveying the recording material together with the fixing film 3 through the fixing nip portion N, heat from the heater is applied to the recording material S via the fixing film 3, thereby thermally fixing an unfixed toner image T on the recording material S onto a surface of the recording material S. The recording material S passed through the fixing nip portion N is separated from a surface of the fixing film 3 and then is conveyed.

In the heater 1, there is provided a ceramic insulating substrate (referred to as "heater substrate") 1*a* which is made of $Al_2O_3$ or AlN and which is an elongated heat-resistive and insulating and good heat-conductive member having a longitudinal direction perpendicular to a conveying direction a of the fixing film 3 or the recording material S as the heated material.

There are further provided a first or long heating body 1*b* and a second or short heating body 1*c* which are formed on a front side of the insulating substrate 1*a* and arranged side by side along the longitudinal direction of the substrate. The two heating bodies 1*b* and 1*c* are formed by patterning and baking by means of screen printing and the like using electrically heat generating resistance paste such as silver palladium (Ag/Pd), $Ta_2N$ or the like.

A length of the first heating body 1*b* corresponds to a width of a fed sheet of a recording material having a maximum size which can be fed through the apparatus (width of large size fed sheet). A length of the second heating body 1*c* corresponds to a width of a small size recording material which can be fed (width of small size fed sheet). Incidentally, in this example, conveyance of the recording material S is based on center reference.

There are further provided load-dispatching wiring patterns 1*f* and 1*g* for the first heating body 1*b*, which are formed on the surface of the insulating substrate to be electrically connected to both ends of the first heating body 1*b* and load-dispatching wiring patterns 1*h* and 1*i* for the second heating body 1*c*, which are formed on the surface of the insulating substrate to be electrically connected to both ends of the second heating body 1*c*. The load-dispatching wiring patterns 1*f*, 1*g*, 1*h* and 1*i* are formed by patterning and baking by means of screen printing and the like using conductive paste such as silver (Ag).

A glass coating baking layer 1*d* serves to protect the surface of the heater and to ensure insulation and is formed to partially cover the first heating body 1*b* and the second heating body 1*c* on an area of the heater surface corresponding to the width of large size fed sheet and the load-dispatching wiring patterns 1*f*, 1*g*, 1*h* and 1*i*.

A temperature detecting element 1*e* such as a thermistor for detecting a temperature of the heater is contacted with a longitudinal central portion on the back surface of the heater, i.e. back surface of the insulating substrate.

The heater 1 is held and fixed by the support 2 in such a manner that the front surface of the heater on which the heating bodies 1*b*, 1*c* and the like is exposed downwardly. Load-dispatching connectors (not shown) are connected to both ends of the heater 1 so that an electrical power is supplied to the first heating body 1*b* from a heater driving circuit through the load-dispatching connectors and the load-dispatching wiring patterns 1*f* and 1*g*, thereby heating the first heating body 1*b*. Further, an electrical power is supplied to the second heating body 1*c* through the load-dispatching connectors and the load-dispatching wiring patterns 1*h* and 1*i*, thereby heating the second heating body 1*c*. The temperature of the entire heater 1 can quickly be increased by heating the first or second or both heating bodies 1*b* and 1*c*.

An example of a general heater driving circuit is shown in FIG. 8. As mentioned above, the heater 1 includes two heating bodies 1*b* and 1*c* and is connected to a commercial AC power supply 201 via switching control elements 204 and 219 such as Triacs so that an electrical power is supplied to the respective heating bodies 1*b* and 1*c* from the AC power supply 201.

The temperature of the heater 1 is detected by the thermistor temperature detecting element 1*e* disposed on the rear surface of the heater and an engine controller 212 as a control circuit performs phase control by controlling ON/OFF of the switching control elements 204 and 219 thereby to turning ON or OFF the supplying of the power to the heater 1 so that the temperature of the thermal fixing apparatus is controlled to be maintained to a target constant temperature. The temperature detected by the thermistor temperature detecting element 1*e* is detected as divided voltage of a resistor 215 and the temperature detecting element 1*e* and is A/D-inputted to the engine controller 212 as a TH signal.

Regarding the two heating bodies 1*b* and 1*c* of the heater 1, voltages supplied thereto are appropriately controlled respectively in accordance with the size of the paper on which the printing is performed, and the printing is performed while switching the lighting ratio of the heating body. In this case, the respective heating bodies 1*b* and 1*c* are phase-driven independently in accordance with the voltages supplied thereto.

A safety device 213 is also provided so that, if the heater detection temperature of the thermistor temperature detecting element 1*e* becomes above an allowable value, the supplying of the electrical power to the heater 1 is stopped immediately by activating the safety device 213.

However, in the above-mentioned conventional example, since the respective heating bodies 1*b* and 1*c* are phase-controlled independently, regarding electrical current flowing in total, as shown in FIG. 9, a wave form of the current is suddenly changed on the way of an energizing period for each half wave, with the result that there arises a problem that a bad influence is affected upon equipments connected to the common commercial power supply, such that a frequency component which increases terminal noise voltage is generated.

SUMMARY OF THE INVENTION

An object of the present invention is to provide to prevent increase in terminal noise voltage in a case where a plurality of heating bodies are driven independently and ratio of electrical power amounts supplied to the respective heating bodies is changed, in order to solve the above-mentioned problem.

The present invention relates to a heating apparatus and an image forming apparatus having the following features:

(1) A heating apparatus comprising a heating member having at least two or more heating bodies and two or more phase electrical power supplying means for supplying electrical powers to the heating bodies in accordance with a phase of AC voltage and wherein a heating ratio of the heating body is changed by thinning, at a predetermined rate, phase wave forms for supplying an electrical power to one of the heating bodies among combinations of the heating body and the phase electrical power supplying means.

(2) A heating apparatus comprising a heating member having at least two or more heating bodies and a shifting member slidingly contacted with the heating member and adapted to heat a heated material by heat from the heating member via the shifting member and further comprising two or more phase electrical power supplying means for supplying electrical powers to the heating bodies in accordance with a phase of AC voltage and wherein a heating ratio of the heating body is changed by thinning, at a predetermined rate, phase wave forms for supplying an electrical power to one of the heating bodies among combinations of the heating body and the phase electrical power supplying means.

(3) A heating apparatus according to (1) or (2), wherein, when the electrical powers are supplied to the respective heating bodies simultaneously, the respective phase wave forms have the same communication angle.

(4) A heating apparatus according to any one of (1) to (3), wherein the respective heating bodies have at least two or more lengths.

(5) A heating apparatus according to any one of (2) to (4), wherein the heated material is a recording material on which an image is born.

(6) An image forming apparatus in which a toner image is formed on a recording material and the toner image is fixed onto the recording material by using thermal fixing means, wherein the thermal fixing means have at least two or more heating bodies, and comprising two or more phase electrical power supplying means for supplying electrical powers to the heating bodies in accordance with a phase of AC voltage and further wherein a heating ratio of the heating body is changed by thinning, at a predetermined rate, phase wave forms for supplying an electrical power to one of the heating bodies among combinations of the heating body and the phase electrical power supplying means.

(7) An image forming apparatus according to (6), wherein, when the electrical powers are supplied to the respective heating bodies, the respective phase wave forms have the same communication angle.

(8) An image forming apparatus according to (6) or (7), wherein the respective heating bodies have at least two or more lengths.

According to the present invention, in a case where the plurality of heating bodies are driven independently and a ratio of an electrical power amount supplied to each heating body is changed, by thinning, at the predetermined rate, the phase wave forms for supplying the electrical power to one of the heating bodies, increase in terminal noise voltage can be prevented.

DESCRIPTION OF THE PREFERRED EMBODIMENTS

The present invention will now be explained in connection with embodiments thereof with reference to the accompanying drawings.

First Embodiment (1) Example of Image Forming Apparatus

Figure 1:
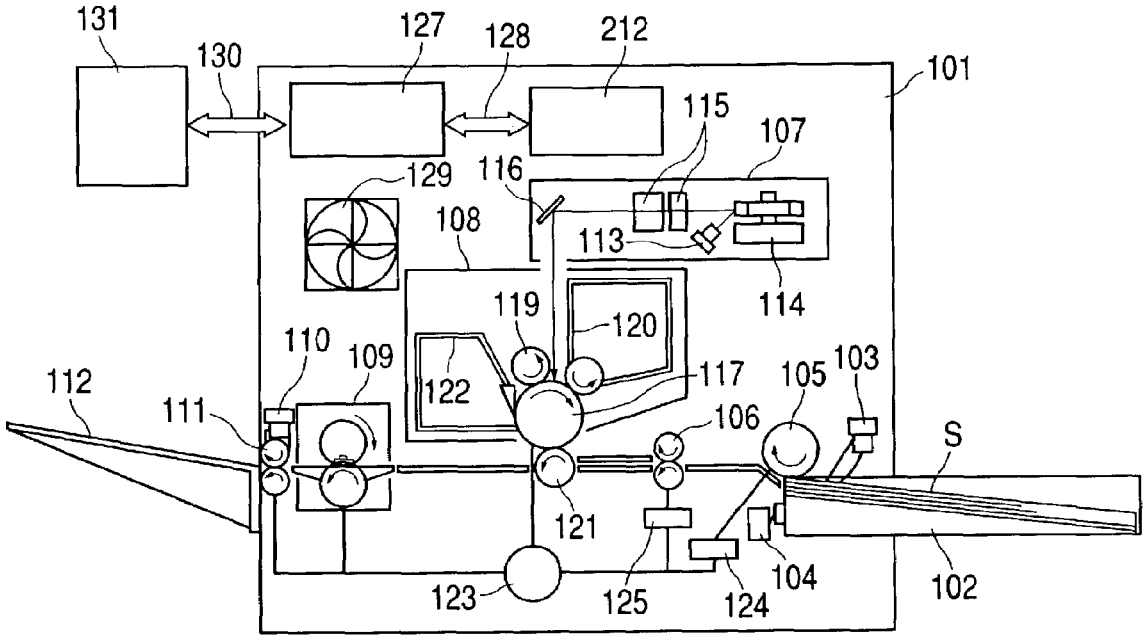
FIG. 1 is a schematic constructional view of an image forming apparatus according to a first embodiment of the present invention.

FIG. 1 is a schematic constructional view showing an example of an image forming apparatus. The image forming apparatus according to this example is a laser beam printer using an electro-photographic process.

The printer includes a laser beam printer main body (referred to merely as "main body" hereinafter) 101 within which an image forming portion 108, a laser scanner portion 107, a sheet feeding cassette 102, a fixing apparatus 109, an engine controller 212, a video controller 127, a main motor 123 and a heat removing fan 129 are disposed.

The image forming portion 108 is constituted by a photosensitive drum 117, a primary electrifying roller 119, a developing device 120, a transfer electrifying roller 121 and a cleaner 122 which are required in a well-known electro-photographic process.

The laser scanner portion 107 is constituted by a laser unit 113, and, a polygon mirror/motor unit 114, a focusing lens 115 and a reflection mirror 116 which serve to scanning the photosensitive drum 117 of the image forming portion 108 with a laser beam from the laser unit.

The video controller 127 is connected to an external device 131 such as a personal computer via a general-purpose interface (such as Centronics, RS232C, USB or the like) 130 and serves to develop image information sent from the general-purpose interface 130 as bit data and to send the bit data as a VDO signal to the engine controller 212 through an interface 128. The engine controller 212 causes the laser unit 113 to output a laser beam modulated on the basis of the image signal VDO.

By the cooperation of the image forming portion 108 and the laser scanner portion 107, a toner image corresponding to the image information is formed on a surface of the photosensitive drum 117 of the image forming portion 108, and the toner image is transferred onto a recording material S fed from the sheet feeding cassette 102 to the transfer electrifying roller 121 at a predetermined control timing. Although the electro-photographic process for forming the toner image on the photosensitive drum 117 is well-known, explanation thereof will be omitted.

The recording materials (recording papers) S are stacked in the sheet feeding cassette 102, and there are provided a recording material presence/absence sensor 103 for detecting presence/absence of the recording material S in the sheet feeding cassette 102, a cassette size sensor 104 (constituted by a plurality of micro-switches) for detecting a size of the recording material S in the sheet feeding cassette 102 and a sheet feeding roller 105 for feeding the recording material S from the sheet feeding cassette 102. A pair of registration rollers 106 for conveying the recording material S to the transfer electrifying roller 121 in a synchronous manner is disposed at a downstream side of the sheet feeding roller 105.

The recording material S which received the toner image from the photosensitive drum 117 at the transfer electrifying roller 121 is separated from the surface of the photosensitive drum 117 and then is introduced into the thermal fixing apparatus 109 as a heating apparatus, where the toner image on the recording material S is subjected to thermal fixing treatment, and the recording material S on which the image was fixed is discharged onto a stacking tray 112 out of the printer by means of a pair of discharging rollers 111. A sheet discharge sensor disposed at a downstream side of the fixing apparatus 109 serves to detect a conveying condition of a sheet discharging portion.

The main motor 123 serves to provide a driving force to the sheet feeding roller 105 via a sheet feeding roller clutch 124 and to provide a driving force to the pair of registration rollers 106 via a registration roller clutch 125 and further serves to provide driving forces to various units (including the photosensitive drum 117) of the image forming portion 108, the fixing apparatus 109 and the pair of sheet discharging rollers 111.

The engine controller 212 performs control of the electro-photographic process executed by the laser scanner portion 107, image forming portion 108 and thermal fixing apparatus 109 and conveyance control of the recording material in the main body 101.

(2) Thermal Fixing Apparatus 109

Figure 2:
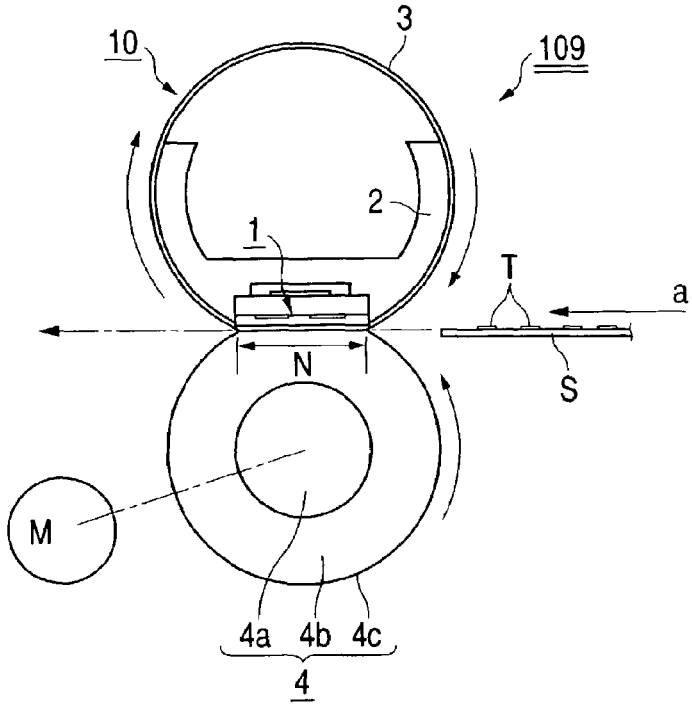
FIG. 2 is a schematic constructional view of a thermal fixing apparatus.

FIG. 2 is a schematic constructional view of the thermal fixing apparatus 109 as the heating apparatus. The thermal fixing apparatus according to this example is a thermal fixing apparatus of film heating type and pressurizing rotary member driving type (tension-less type) using a cylindrical (endless) fixing film as disclosed in Japanese Patent Application Laid-open Nos. 4-44075 to 4-44083 and 4-204980 to 4-204984.

The fixing apparatus includes a fixing member (fixing unit) 10 and a pressurizing roller 4 as a pressurizing member and a fixing nip portion N is formed by urging the fixing member 10 and the pressurizing roller 4 against each other.

The fixing member 10 is a member having a longitudinal direction perpendicular to the plane of FIG. 2 and comprises a heat-resistive rigid support 2 of bucket type having a substantially half circle cross-section, a heater 1 as a heating body fixedly fitted in a groove formed in a lower surface of the support 2 along the longitudinal direction of the fixing member and a cylindrical heat-resistive fixing film 3 loosely mounted around the support 2 to which the heater 1 is attached.

The pressurizing roller 4 is a rotary member comprising a metal core 4*a* and an elastic layer 4*b* coaxially mounted around the metal core and made of heat-resistive rubber such as silicone runner or fluoro-rubber or formed foaming silicone rubber. A heat-resistive mold releasing layer 4*c* made of fluoro-rubber such as PFA, PTFE or FEP may be formed around the elastic layer 4*b*.

The pressurizing roller 4 is rotatably mounted by rotatably supporting both ends of the roller via bearing members between front and rear side plates of a chassis (not shown) of the apparatus.

The fixing member 10 is disposed on the pressurizing roller 4 in parallel with each other with the heater 1 facing downwardly. By biasing both ends of the support 2 by means of pressurizing means such as springs (not shown) toward an axis of the pressurizing roller 4, the lower surface of the heater 1 is urged against the elastic layer 4*b* of the pressurizing roller 4 with the interposition of the fixing film 3 with a predetermined urging force in opposition to elasticity of the elastic layer, thereby forming a fixing nip portion N having a predetermined width required for thermal fixing. It may be designed so that the fixing nip portion N having the predetermined width is formed by biasing the pressurizing roller 4 upwardly by means of pressurizing means to be urged against the lower surface of the fixing member 10.

The pressurizing roller 4 is rotatingly driven by means of driving means M at a predetermined peripheral speed in an anti-clockwise direction shown by the arrow. Due to an urging friction force between the peripheral surface of the pressurizing roller 4 and the fixing film 3 generated by the rotation of the pressurizing roller 4 at the fixing nip portion N, a rotational force acts on the cylindrical fixing film 3, with the result that the fixing film 3 is rotatingly driven around the support 2 in a clockwise direction shown by the arrows while closely contacting the inner surface of the film with the lower surface of the heater 1.

In a condition that the pressurizing roller 4 is rotatingly driven and accordingly the cylindrical fixing film 3 is rotatingly driven and the heater 1 is energized and the temperature of the heater is adjusted to a predetermined temperature, the recording material S bearing a unfixed toner image T thereon is introduced between the fixing film 3 and the pressurizing roller 4 at the fixing nip portion N, where the surface of the recording material S on which the toner image is born is closely contacted with the outer surface of the fixing film 3 and is conveyed together with the fixing film 3 through the fixing nip portion N. During such conveyance, heat from the heater 1 is applied to the recording material S via the fixing film 3, with the result that the unfixed toner image T on the recording material S is fused and fixed onto the recording material S heat and pressure.

The recording material S passed through the fixing nip portion N is separated from the fixing film 3 by curvature separation.

Figure 7A:
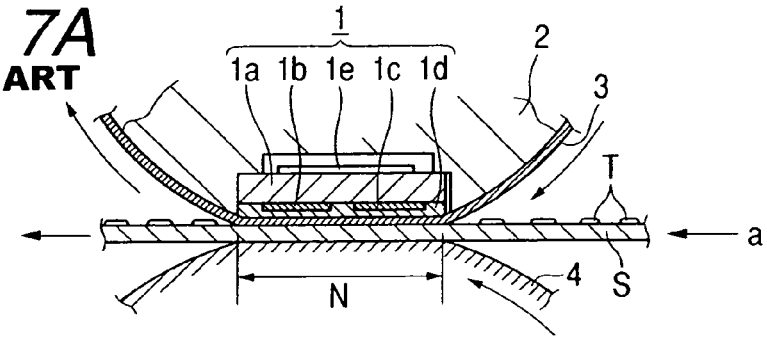
FIG. 7A PRIOR ART
FIGS. 7A, 7B and 7C are schematic constructional views of a heating member in a conventional example.
Figure 7B:
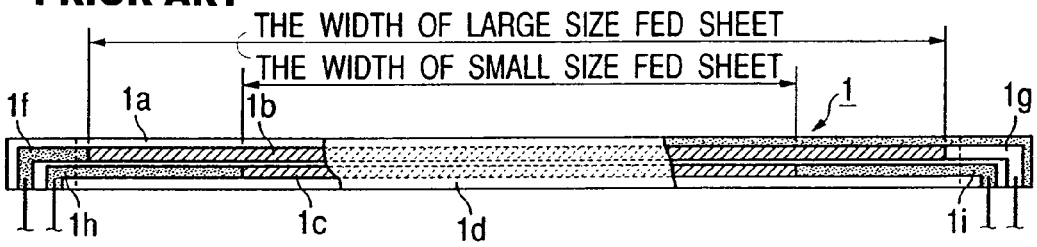
FIG. 7B PRIOR ART
Figure 7C:
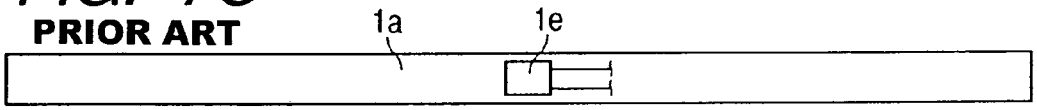
FIG. 7C PRIOR ART
Figure 8:
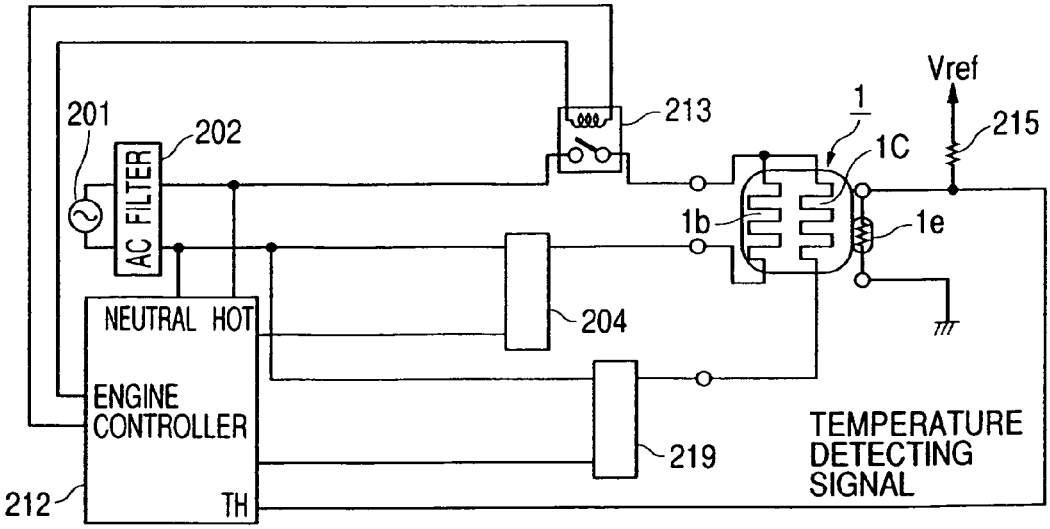
FIG. 8 PRIOR ART
FIG. 8 is a view showing a heater driving circuit.
Figure 9:
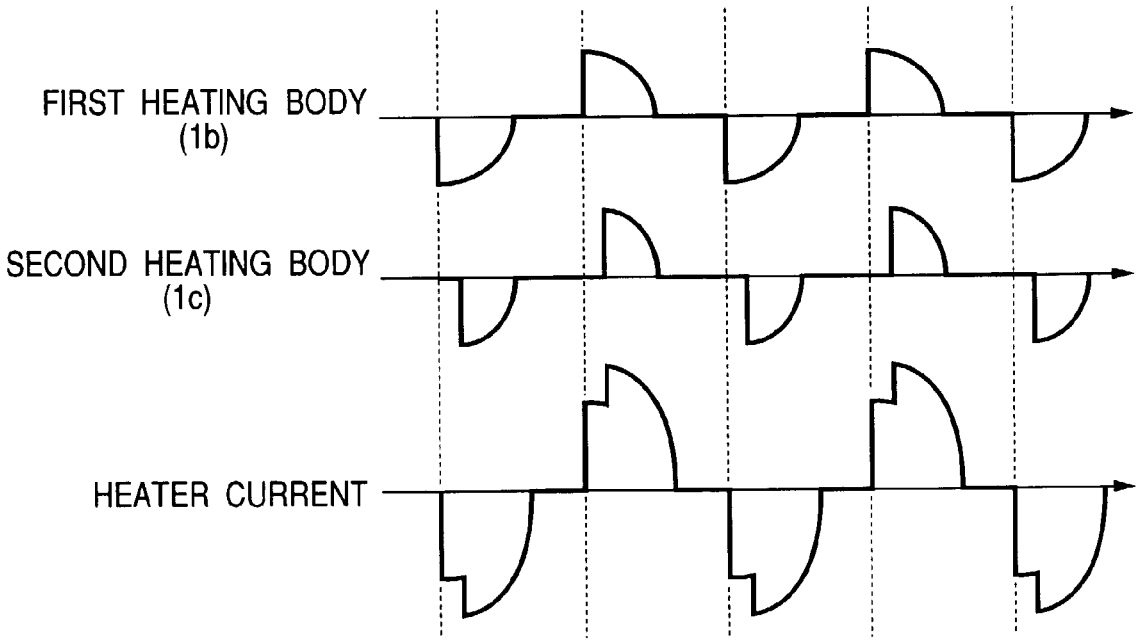
FIG. 9 is a view showing operating wave forms.

Since the heater 1 as the heating member is a ceramic surface heat generating heater having two heating bodies, i.e. first heating body 1*b* and second heating body 1*c* same as the above-mentioned heater 1 of FIGS. 7A to 7C, explanation thereof will be omitted.

Figure 3:
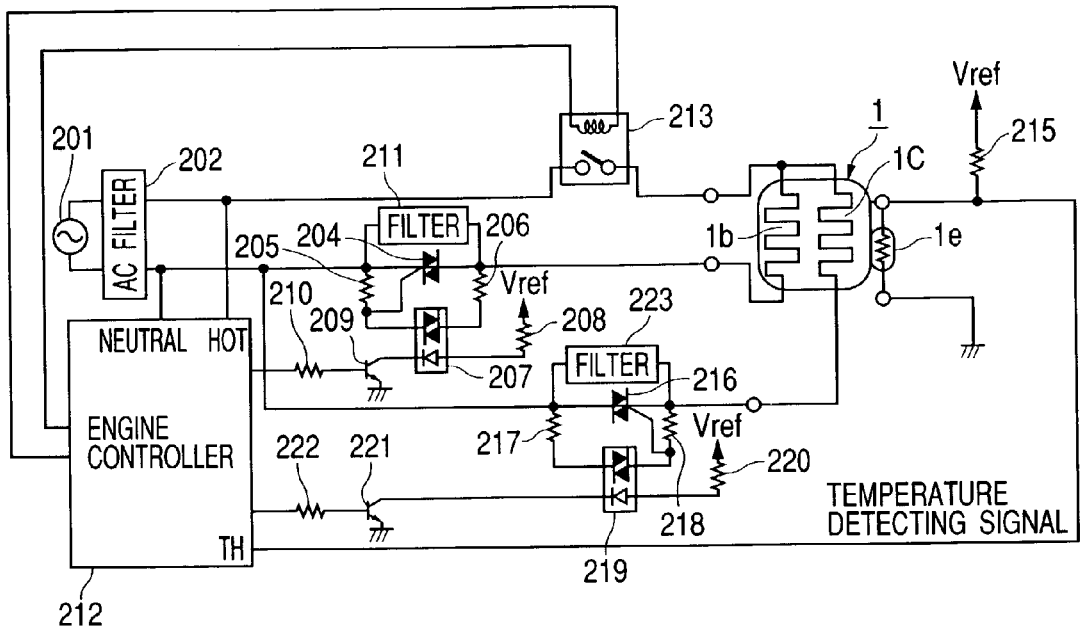
FIG. 3 is a view showing a heater driving circuit.

FIG. 3 shows a heater driving circuit. The circuit includes a commercial AC power supply 201 connected to the main body 101 (FIG. 1) of the image forming apparatus. The main body 101 of the image forming apparatus heats the heater 1 by supplying an electrical power from the commercial power supply to the heater 1 via a filter 202. Regarding the supplying of the electrical power to the heater 1, energization/block is controlled by Triacs 204 and 216. Resistors 205, 206 and 217, 218 are bias resistors for the Triacs 204 and 216, respectively, and photo-Triac couplers 207 and 219 are devices for maintaining an insulation distance between primary and secondary. By energizing light emitting diodes of the photo-Triac couplers 207 and 219, the Triacs 204 and 216 are turned ON. Resistors 208 and 220 are resistors for limiting electrical currents flowing into the light emitting diodes of the photo-Triac couplers 207 and 219 and are turned ON/OFF by transistors 209 and 221. The transistors 209 and 221 are operated in accordance with ON signals from the engine controller 212 via resistors 210 and 222, respectively.

Further, the AC power supply 201 is inputted to zero-cross detecting terminals "Neutral" and "Hot" of the engine controller 212 via an AC filter 202. In the zero-cross detecting terminals of the engine controller 212, the fact that commercial power supply voltage is below a certain threshold value is informed to a CPU (not shown) as a pulse signal. Hereinafter, the pulse signal sent to the CPU in the engine controller 212 is referred to as "ZEROX signal".

The engine controller 212 performs ON/OFF of the Triacs 204 and 216 by phase control in accordance with a pulse edge of the ZEROX signal.

Further, the temperature of the heater 1 detected by the temperature detecting element 1*e* is detected as divided voltage of a resistor 215 and the temperature detecting element 1*e* and is A/D-inputted to the engine controller 212 as a TH signal. The temperature of the heater 1 is monitored as the TH signal in the engine controller 212, and, by comparing the heater temperature with a setting temperature of the heater 1 set in the engine controller 212, the electrical power to be supplied to the heater 1 is calculated, and the calculated value is converted into a phase angle corresponding to the supplied electrical power, and, under such a control condition, the engine controller 212 sends ON signals to the transistors 209 and 221.

A safety device 213 is also provided so that, if the heater detection temperature of the thermistor temperature detecting element 1*e* becomes above an allowable value, the supplying of the electrical power to the heater 1 is stopped immediately by activating the safety device 213.

In the above explanation, the members 204 to 211 and the members 216 to 222, particularly, the members 204 and 216 are two or more phase electrical power supplying means. Further, the engine controller 212 is means for changing a heating ratio of the heating body by thinning, at a predetermined rate, phase wave forms for supplying the electrical power to one of the heating bodies among combinations of the heating bodies and the phase electrical power supplying means. When the Triacs 204 and 216 are actually turned ON/OFF, although great noise is generated, the filters 211 and 223 serve to reduce such noise and also serve to protect from external noise (thunder surge) of the switching elements 204 and 216. As mentioned above, the first heating body 1*b* and the second heating body 1*c* have different lengths and the ratio of the electrical powers to be supplied to the respective heating bodies 1*b* and 1*c* are changed in accordance with the size of the recording material S.

An example of an ON pattern of half end unit for changing the heating ratio of the heating body is shown in the following Table 1:

TABLE 1

| Lighting | TURN-ON Pattern per Half End (Unit) (20 waves period) | | | | | | | | | | | | | | | | | | | |
|---|---|---|---|---|---|---|---|---|---|---|---|---|---|---|---|---|---|---|---|---|
| Ratio | 1 | | 2 | | 3 | | 4 | | 5 | | 6 | | 7 | | 8 | | 9 | | 10 | |
| 1.0 | 1 | 1 | 1 | 1 | 1 | 1 | 1 | 1 | 1 | 1 | 1 | 1 | 1 | 1 | 1 | 1 | 1 | 1 | 1 | 1 |
| 0.9 | 0 | 1 | 1 | 1 | 1 | 1 | 1 | 1 | 1 | 1 | 1 | 0 | 1 | 1 | 1 | 1 | 1 | 1 | 1 | 1 |
| 0.8 | 0 | 1 | 1 | 1 | 1 | 0 | 1 | 1 | 1 | 1 | 0 | 1 | 1 | 1 | 1 | 0 | 1 | 1 | 1 | 1 |
| 0.7 | 0 | 1 | 1 | 1 | 0 | 1 | 1 | 0 | 1 | 1 | 1 | 0 | 1 | 1 | 0 | 1 | 1 | 0 | 1 | 1 |
| 0.6 | 0 | 1 | 1 | 0 | 1 | 0 | 1 | 1 | 0 | 1 | 0 | 1 | 1 | 0 | 1 | 0 | 1 | 1 | 0 | 1 |
| 0.5 | 0 | 1 | 0 | 1 | 0 | 1 | 0 | 1 | 0 | 1 | 1 | 0 | 1 | 0 | 1 | 0 | 1 | 0 | 1 | 0 |
| 0.4 | 1 | 0 | 0 | 1 | 0 | 1 | 0 | 0 | 1 | 0 | 1 | 0 | 0 | 1 | 0 | 1 | 0 | 0 | 1 | 0 |
| 0.3 | 1 | 0 | 0 | 0 | 1 | 0 | 0 | 1 | 0 | 0 | 0 | 1 | 0 | 0 | 1 | 0 | 0 | 1 | 0 | 0 |
| 0.2 | 1 | 0 | 0 | 0 | 0 | 1 | 0 | 0 | 0 | 0 | 1 | 0 | 0 | 0 | 0 | 1 | 0 | 0 | 0 | 0 |
| 0.1 | 1 | 0 | 0 | 0 | 0 | 0 | 0 | 0 | 0 | 0 | 0 | 1 | 0 | 0 | 0 | 0 | 0 | 0 | 0 | 0 |
| 0.0 | 0 | 0 | 0 | 0 | 0 | 0 | 0 | 0 | 0 | 0 | 0 | 0 | 0 | 0 | 0 | 0 | 0 | 0 | 0 | 0 |

For example, a case where the sheet width of the recording material S passed onto the heater 1 is between the length of the first heating body 1*b* and the length of the second heating body 1*c*, it is required that the ratio of the electrical powers supplied to the first heating body 1*b* and the second heating body 1*c* be changed. Electrical current wave forms flowing into the heater 1 in such a case are shown in FIG. 4.

Figure 4:
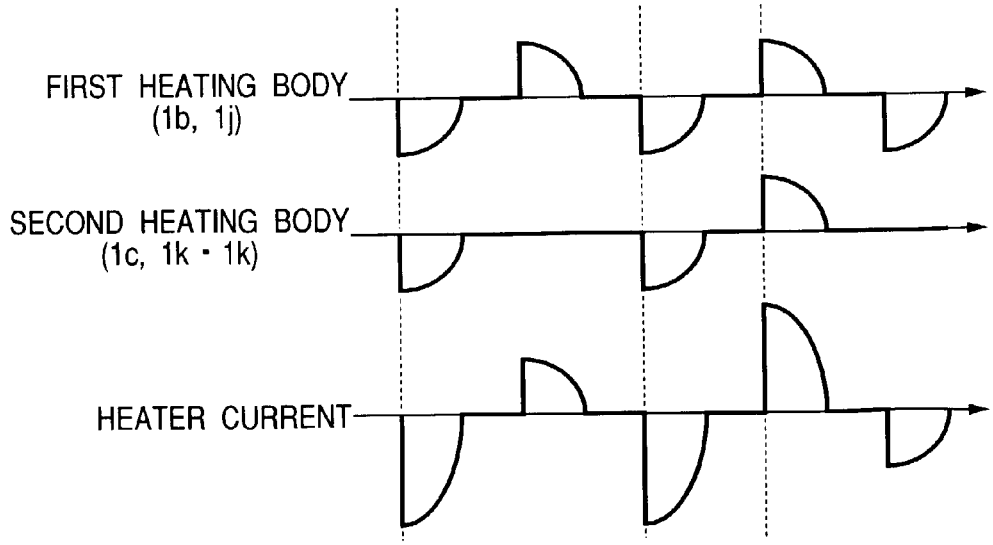
FIG. 4 is a view showing operating wave forms.

In FIG. 4, wave forms used when the electrical power (lighting ratio 0.6 in the Table 1 (half waves between third period and front half of fifth period in FIG. 4) supplied to the second heating body 1*c* is reduced in comparison with the electrical power (lighting ratio 1.0 in the Table 1) supplied to the first heating body 1*b* are shown. When both of the first heating body 1*b* and the second heating body 1*c* are turned ON, the communication angles are made to be the same by simultaneous ON timing of the phase control. And, at the same time, the phase wave forms are thinned at a desired rate as shown. In this example, when the lighting ratio of the first heating body 1*b* is selected to 1, the lighting ratio of the second heating body 1*c* becomes 0.6, and, accordingly, the lighting ratio of the second heating body 1*c* with respect to the first heating body 1*b* is about 60%. Incidentally, the lighting ratio can appropriately be changed to an optimum value in accordance with the paper size and/or continuous print sheet number. Normally, the greater the paper size is, the greater the lighting ratio of the first heating body 1*b* is. Further, when the number of continuous small size prints is increased, the lighting ratio of the second heating body 1*c* is increased in comparison with the case where the continuous print sheet number is small.

As mentioned above, by setting the same timing communication angles of the phase control of the first heating body 1*b* and the second heating body 1*c* and by thinning, at the predetermined rate, the phase wave forms for supplying the electrical power to one of the heating bodies thereby to change the lighting ratio of the heating body, the electrical current wave form is not changed abruptly during the energization period, with the result that a problem regarding the terminal noise voltage and a problem that a bad influence is affected upon the equipments connected to the common commercial power supply can be eliminated.

Incidentally, in the above embodiment, while an example that two heating bodies are used was explained, the present invention can be applied to a case where a heater is constituted by three or more heating bodies. Further, as is in the above embodiment, not only two or more heating bodies having different lengths are used, but also it can be considered that resistance values are changed or various combinations of heating bodies are used.

Second Embodiment

Figure 5A:
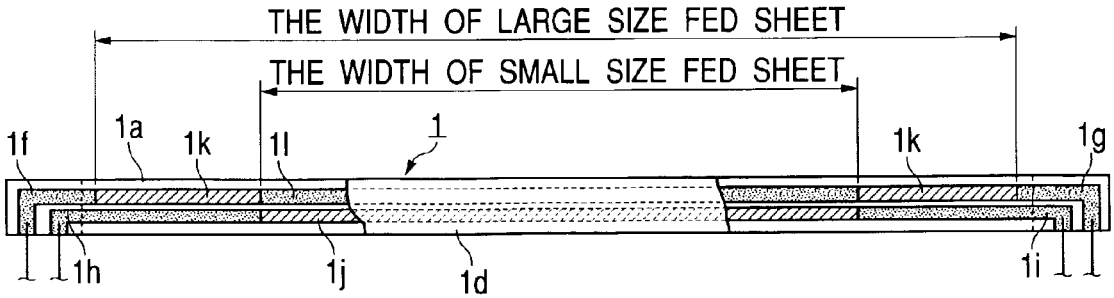
FIGS. 5A and 5B are schematic constructional views of a heating member (heater) according to a second embodiment of the present invention.
Figure 5B:
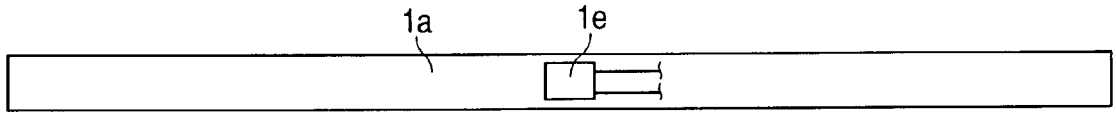

In a second embodiment, as shown in FIGS. 5A and 5B, a heater 1 is used as a heating member. Since the other constructions of the thermal fixing apparatus are the same as those in the first embodiment, explanation thereof will be omitted.

In FIGS. 5A and 5B, a first heating body 1*j* has a length corresponding to a width of a small size recording material which can be fed (width of small size fed sheet). A second heating body 1*k* has two divided areas which extend one end of the first heating body 1*j* to an outer area portion and the other end to an outer area portion, respectively, and an entire length obtained by adding length of two second heating bodies 1*k* and the length of the first heating body 1*j* corresponds to a width of a fed sheet of a recording material having a maximum size which can be fed through the apparatus (width of large size fed sheet). The two second heating bodies 1*k* are electrically interconnected by a wiring pattern 1*l*. Since the other constructions of the heater, i.e. insulating substrate 1*a*, wiring patterns 1*f*, 1*g*, 1*h* and 1*i*, glass coating baking layer 1*d*, temperature detecting element 1*e*, power-dispatching connectors and the like are the same as those in the above-mentioned heater 1 of FIG. 6, explanation thereof will be omitted.

An electrical power is supplied to the first heating body 1*j* via the wiring patterns 1*h* and 1*i*. An electrical power is supplied to the two second heating bodies 1*k* via the wiring patterns 1*h*, 1*l* and 1*i*. Regarding the first heating body 1*j* and the second heating bodies 1*k*, the electrical power is supplied to the second heating bodies 1*k* in accordance with the size of the recording material S or the ratio of the electrical power supplied to the second heating bodies 1*k* is changed.

Similar to the above-mentioned first embodiment, wave forms of electrical currents supplied to the first heating body 1*j* and the second heating bodies 1*k* are shown in FIG. 4. An example that the size of the recording material S reaches the areas of the second heating bodies 1*k* but does not reach the outer ends of the second heating bodies 1*k* is shown.

Others

1) Of course, the construction of the heater 1 as the heating member is not limited to the embodiments.

Figure 6:
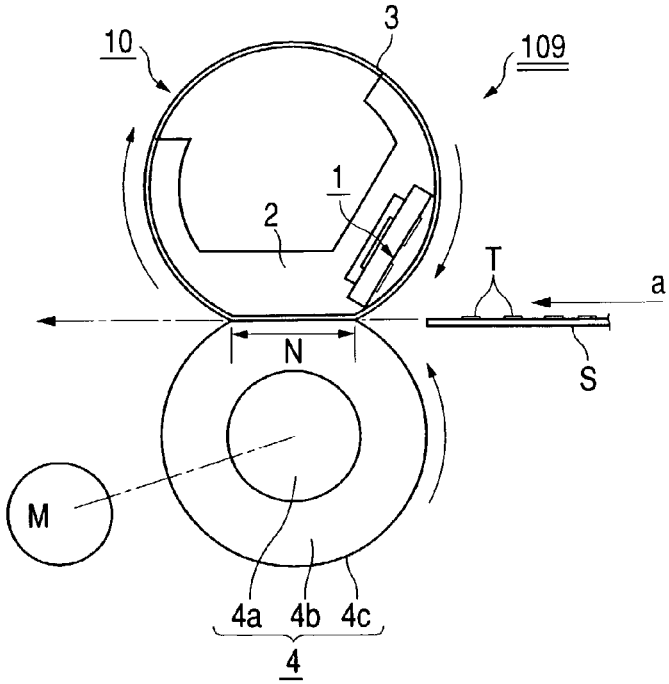
FIG. 6 is a schematic constructional view of a thermal fixing apparatus according to another constructional example.

The heater 1 may not necessarily be positioned at the fixing nip portion N. For example, as shown in FIG. 6, the heater 1 may be positioned at an upstream side of the fixing nip portion N in a shifting direction of the fixing film.

2) Regarding the thermal fixing apparatus of film heating type, while an example that the fixing apparatus of pressurizing rotary member driving type was explained in the embodiment, a fixing apparatus of type in which a driving roller is provided within an endless fixing film and the film is driven while applying tension to the film may be used or a fixing apparatus of type in which a film formed as rolled web having both ends and such a film is run.

3) The pressurizing member is not limited to the roller. The pressurizing member may be a belt rotatingly driven. The pressurizing member may also be heated by a heat source.

4) Of course, the heating apparatus is not limited to the film heating type. That is to say, a heating apparatus in which a plurality of heating bodies is driven independently and a heated material is directly or indirectly applied to a heating member for generating heat by changing the ratio of electrical power amounts supplied to the respective heating bodies thereby heat the heated material may be used.

5) The heating apparatus according to the present invention is not limited to the thermal fixing apparatus, but may be applied to a drying heating apparatus used in an ink jet printer, such as an image heating apparatus for performing false fixing, an image heating apparatus in which a recording medium bearing an image thereon is re-heated to improve a surface property of the medium such as gloss or a heating treatment apparatus in which a sheet other than a recording medium is passed and to perform drying, heat laminate, heat press wrinkle removal or heat press curl.

What is claimed is:

1. A heating apparatus comprising:

first and second heating bodies; and a phase control part for performing phase angle control of supplying of alternate currents into said first and second heating bodies, wherein, in a case that said phase control part controls the phase angles of voltages applied to both said first and second heating bodies to transfer their condition between an energized condition and a non-energized condition at a portion in a half cycle of the alternate currents, said phase control part controls the phase angles to transfer their condition between an energized condition and a non-energized condition at the same timing, and, wherein, in a case that said phase control part controls a phase angle of a voltage applied to one of said first and second heating bodies to transfer its condition between an energized condition and a non-energized condition in a half cycle of the alternate current, said phase control part turns off the alternate current of the other of said first and second heating bodies in a whole part in a half cycle of the alternate current, thereby a proportion of supplied power to both said first and second heating bodies is capable of being variable without performing a phase control in said first and second heating bodies independently.

2. A heating apparatus according to claim 1, further comprising a moving member for sliding on said first and second heating bodies, wherein a material to be heated is heated by heat from said heating bodies via said moving member.

3. A heating apparatus according to claim 2, wherein the heated material is a recording material on which an image is formed.

4. A heating apparatus according to claim 1, wherein said first and second heating bodies have different lengths.

5. An image forming apparatus for forming a toner image on a recording material, comprising:

thermal fixing means including first and second heating bodies for fixing the toner image onto the recording material; and a phase control part for performing phase angle control of supplying of alternate currents into said first and second heating bodies, wherein, in a case that said phase control part controls the phase angles of voltage applied to both said first and second heating bodies to transfer their condition between an energized condition and a non-energized condition at a portion in a half cycle of the alternate currents, said phase control part controls the phase angles to transfer their condition between an energized condition and a non-energized condition at the same timing, and, wherein, in a case that said phase control part controls a phase angle of a voltage applied to one of said first and second heating bodies to transfer its condition between an energized condition and a non-energized condition in a half cycle of the alternate current, said phase control part turns off the alternate current of the other of said first and second heating bodies in a whole part in a half cycle of the alternate current, thereby a proportion of supplied power to both said first and second heating bodies is capable of being variable without performing a phase control part in said first and second heating bodies independently.

6. An image forming apparatus according to claim 5, wherein said first and second heating bodies have different lengths.

7. A heating apparatus comprising:

first and second heating bodies; and a phase controller for performing a phase angle control of supplying of alternate currents into said first and second heating bodies, wherein, in a case that said phase controller performs the phase angles of voltage applied to both said first and second heating bodies to transfer their condition between an energized condition and a non-energized condition at a portion in a half cycle of the alternate currents, said phase controller controls the phase angles to transfer their condition between an energized condition and a non-energized condition at the same timing, and, wherein, in a case that said phase controller controls a phase angle of a voltage applied to one of said first and second heating bodies to transfer its condition between an energized condition and a non-energized condition in a half cycle of the alternate current, said phase controller turns off the alternate current of the other of said first and second heating bodies in a whole part in a half cycle of the alternate current, thereby a proportion of supplied power to both said first and second heating bodies is capable of being variable without performing a phase control in said first and second heating bodies independently.

8. A heating apparatus according to claim 7, wherein said each of said first and second heating bodies have different lengths.

9. An image forming apparatus for forming a toner image on a recording material, comprising:

first and second heating bodies, provided in a fixing member, to fix a toner image onto the recording material; and a phase controller for performing a phase angle control of supplying of alternate currents into said first and second heating bodies, wherein, in a case that said phase controller controls the phase angles of voltage applied to both said first and second heating bodies to transfer their condition between an energized condition and a non-energized condition at a portion in a half cycle of the alternate currents, said phase controller controls the phase angles to transfer their condition between an energized condition and a non-energized condition at the same timing, and, wherein, in a case that said phase controller controls a phase angle of a voltage applied to one of said first and second heating bodies to transfer its condition between an energized condition and a non-energized condition in a half cycle of the alternate current, said phase controller controls turns off the alternate current of the other of said first and second heating bodies in a whole part in a half cycle of the alternate current thereby a proportion of supplied power to both said first and second heating bodies is capable of being variable without performing a phase control in said first and second heating bodies independently.

10. An image forming apparatus according to claim 9, wherein said each of said first and second heating bodies have different lengths.

* * * * *

UNITED STATES PATENT AND TRADEMARK OFFICE

CERTIFICATE OF CORRECTION

PATENT NO. : 7,015,431 B2
APPLICATION NO. : 10/457359
DATED : March 21, 2006
INVENTOR(S) : Shotaro Yoshimura It is certified that error appears in the above-identified patent and that said Letters Patent is hereby corrected as shown below:

COLUMN 3:
Line 24, “are” should read --is--.
Line 60, “born.” should read --borne.--.

COLUMN 12:
Line 15, “have” should read --has--.
Line 48, “have” should read --has--.

Signed and Sealed this

Seventeenth Day of October, 2006

JON W. DUDAS
*Director of the United States Patent and Trademark Office*